US006242821B1

(12) United States Patent
Macks

(10) Patent No.: US 6,242,821 B1
(45) Date of Patent: Jun. 5, 2001

(54) CMOS PASSIVE INPUT CIRCUIT

(75) Inventor: Harold Ryan Macks, Redford, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/327,287

(22) Filed: Jun. 7, 1999

(51) Int. Cl.[7] ..... H01H 47/00
(52) U.S. Cl. ..... 307/125; 326/30; 340/644
(58) Field of Search ..... 340/644, 649, 340/650; 701/36; 327/18, 20; 326/30, 37, 38; 307/116, 125

(56) References Cited

U.S. PATENT DOCUMENTS

| | | | | |
|---|---|---|---|---|
| 4,420,669 | | 12/1983 | Scalf et al. | 219/10.55 B |
| 4,532,432 | | 7/1985 | Mizuno et al. | 307/10 R |
| 4,728,810 | * | 3/1988 | Engel | 307/108 |
| 5,184,026 | | 2/1993 | O Breartuin | 307/139 |
| 5,258,654 | * | 11/1993 | Roberts et al. | 307/125 |
| 5,754,890 | | 5/1998 | Holmdahl et al. | 395/883 |
| 5,783,875 | | 7/1998 | Jaros | 307/116 |
| 5,912,566 | * | 6/1999 | Tamura | 327/20 |
| 6,130,488 | * | 10/2000 | Hansen et al. | 307/125 |
| B1 6,188,225 | * | 2/2001 | Tislaric | 340/644 |

* cited by examiner

*Primary Examiner*—Josie Ballato
*Assistant Examiner*—Roberto Rios Cuevas
(74) *Attorney, Agent, or Firm*—Mark L. Mollon

(57) ABSTRACT

A passive processing circuit for processing a ground side switch closure to a CMOS input (20) of an MCU, particularly useful in a D.C. electrical system where ground offsets may occur, such as in an automotive vehicle. Three resistors (R1, R2, R3) are connected between supply and ground potentials of a D.C. power supply voltage (10). The junction of two (R1, R2) connects to an output (16) of a grounded input switch (12). The junction of two (R2, R3) connects to the CMOS input (20). A fourth resistor (R4) connects between the bi-directional input/output (22) of the MCU and the junction of the second and third resistors. The MCU executes an algorithm that selectively allows and disallows the resistor (R4) to coact with the second and third resistors. The circuit provides a cost-efficient solution for extending the range of supply line voltage over which a CMOS input can correctly read a switch closure.

12 Claims, 1 Drawing Sheet

CM OS PASSIVE INPUT CIRCUIT

BACKGROUND OF THE INVENTION

1. Field of the Invention

This invention relates generally to circuits for processing switch actuations to electronic circuitry, and in particular to an improved passive input circuit that processes closure of a grounded mechanical input switch to a CMOS input. The invention is especially useful in D.C. electrical systems of automotive vehicles.

2. Background Information

Automotive vehicles have various electronic modules that perform various functions associated with vehicle operations. Possible types of inputs to such modules include inputs from mechanical switches. Mechanical switches are useful in automotive vehicles for various reasons, including for example, their suitability for the diverse environmental conditions which vehicles may encounter during their useful lives, their economical cost, and their general reliability. A grounding type mechanical switch may be useful in any of various applications in an automotive vehicle.

Because of the nature of certain grounding type mechanical switches and the nature of certain automotive vehicle electrical systems, the closure of such a switch may not always cause a true ground, i.e. zero volts, at an input of an electronic module that monitors, or reads, the switch. Such an input may include a ground offset, meaning that the actual voltage input applied to a module upon switch closure is close to, but not precisely, zero volts. The closed switch may also exhibit a certain series impedance in the input to the module to which it is electrically connected. Moreover, an electrical charging system of an automotive vehicle may deliver an actual power supply voltage that varies considerably from nominal. Voltage extremes of a nominal +12 volt D.C. electric power supply in an automotive vehicle may range from a few volts above ground to voltages well above nominal, such as from +6 volts D.C. to +18 volts D.C. for example.

For processing closures of such switches in automotive vehicles, associated modules may include embedded microcomputers. Such microcomputers may have CMOS type input structures. Accordingly, it is known to process the closure of a grounded switch into a CMOS input. A known processing circuit for level shifting a ground side switch into a CMOS input comprises a diode and three resistors. In a positive polarity electrical system, the anode of the diode is connected to the positive supply voltage and the cathode of the diode is connected to a terminal of a first of the three resistors. The second and third resistors are connected in series between the other terminal of the first resistor and ground. The output terminal of the mechanical switch is connected to the junction of the first and second resistors while the switch input terminal is connected to the electrical system ground. The junction of the second and third resistors is connected to the appropriate CMOS input of the module that monitors the condition of the switch.

The diode provides reserve voltage protection by preventing any negative transients that may occur on the voltage supply line from reaching the CMOS input. The first resistor provides a potential that the mechanical switch can pull against, and it also provides a certain switch wetting current that may aid in keeping the switch contacts clean. The second resistor limits the electric current that can be injected into the CMOS input due to higher than nominal voltages (D.C. or transient) on the supply voltage line. The third resistor completes a voltage divider that, when the switch is closed, keeps a positive ground offset voltage from being improperly interpreted, or improperly read, as a logic "1" signal. One advantage of the known processing circuit that has just been described is that it comprises relatively few circuit components.

The present invention arises from the inventor's recognition of certain limitations of that circuit which, under certain conditions, may cause the actual switch condition to be misinterpreted, or misread, either as a logic "1" signal when the correct signal should be a logic "0" signal, or as a logic "0" signal when the correct signal should be a logic "1" signal.

The inventor believes that such misreading may be due to any one or more of various causes including: greater than 5% variance in resistance values of nominal 5% tolerance resistors because of factors like component aging and thermal effects; an inability of a CMOS input to determine the logic value of an input over a certain intermediate portion of an input voltage range (for example an intermediate range between +1 volt and +3.5 volts in the case of a module that uses a +5 volt supply voltage); disparity between actual values of ground voltage at the switch and ground voltage at the module; significant switch impedance when closed; departure of actual supply voltage from nominal (i.e. +6 volts to +18 volts).

Factors other than those just mentioned (switch, wiring harness, and PWB leakage, for example) may also play roles, but their impact is believed less significant. The known processing circuit described above is believed suitable for supply voltages ranging from +10 volts to +16 volts, in spite of the adverse influence of the factors previously mentioned.

Because it is possible that the supply voltage in an automotive vehicle may vary over a more extensive range than between +10 volts to +16 volts, further improvements in switch closure processing circuits is seen to be desirable. While it is possible that such improvements may be accomplished by active, as distinguished from passive, processing circuits, active processing circuits generally add complexity and cost. Accordingly, it is believed most desirable to achieve a solution that retains the use of a passive processing circuit.

A preliminary novelty search in connection with this invention developed the following U.S. Pat. Nos.: 4,420,669; 4,532,432; 5,184,026; 5,754,890; and 5,783,875; as representative of the state of the art.

SUMMARY OF THE INVENTION

Generally speaking, the present invention relates to a passive processing circuit for processing a ground side switch closure to a CMOS input. The invention is particularly advantageous in an automotive vehicle D.C. electrical system where ground offsets may occur.

One generic aspect of the invention relates to a processing circuit, for use with a D.C. power supply that comprises supply and ground potentials, to process ground side closure of a switch to a CMOS input of an MCU that also has a bi-directional input/output (I/O), the processing circuit comprising, in combination with the switch and MCU: a first resistor through which an output of the switch to which ground is switched during switch closure is adapted to be connected to the supply potential; second and third resistors in series, in that order, through which the switch output is adapted to be connected to ground potential; and a fourth resistor through which the bi-directional I/O of the MCU is connected to a node that is common to the CMOS input, to the second resistor, and to the third resistor, for causing the equivalent resistance between that node and ground potential to be relatively larger when the MCU is configuring the bi-directional I/O as an input and to be relatively smaller when the MCU is configuring the bi-directional I/O as an output to ground.

Another generic aspect of the invention relates to an automotive vehicle comprising: an electrical system including an electric power supply that delivers D.C. electric power across supply and ground potentials; a ground connection from the ground potential of the D.C. electrical system to vehicle ground; a switch comprising switch contacts between a first terminal of the switch and a second terminal of the switch and selectively operable to open and closed states to open and close a current path between the first and second terminals; a ground connection from the first switch terminal to vehicle ground; an MCU that is supplied with electric power derived from the vehicle electrical system, and that has an MCU ground, a bi-directional input/output (I/O), and a CMOS input; a ground connection from the MCU ground to vehicle ground; a processing circuit connecting the switch to the vehicle electrical system and to the MCU for enabling the MCU to read the state of the switch contacts; the processing circuit comprising a first resistor through which the second switch terminal is connected to the supply potential; second and third resistors in series, in that order, through which the second terminal of the switch is connected to one of the grounds; and a fourth resistor through which the bi-directional I/O of the MCU is connected to a node that is common to the CMOS input, to the second resistor, and to the third resistor, for causing the equivalent resistance between that node the one ground to be relatively larger when the MCU is configuring the bi-directional I/O as an input and to be relatively smaller when MCU is configuring the bi-directional I/O as an output to MCU ground.

Still another generic aspect of the invention relates to a method for an MCU that has a CMOS input and a bi-directional input/output (I/O) to read closure of a grounding type switch in an automotive vehicle that has a D.C. voltage source, wherein a processing circuit that includes a first resistor through which an output of the switch to which ground is switched during switch closure is connected to a supply potential of the D.C. voltage source, second and third resistors in series, in that order, through which the switch output is connected to a ground, and a fourth resistor through which the bi-directional I/O of the MCU is connected to a node that is common to the CMOS input, to the second resistor, and to the third resistor, the method comprising: configuring the bi-directional input/output to allow the fourth resistor to coact with the second and third resistors, and while the bi-directional input/output is so configured, reading a signal at the CMOS input; accepting the read signal as a correct signal if the read signal corresponds with one logic level of a binary logic signal; if the read signal corresponds with the other logic level of the binary signal, re-configuring the bi-directional input/output to disallow the fourth resistor from coacting with the second and third resistors, and then re-reading the signal at the CMOS input; and accepting the re-read signal at the CMOS input as a correct signal.

Other general and more specific aspects will be set forth in the ensuing description and claims.

BRIEF DESCRIPTION OF THE DRAWINGS

The drawings that will now be briefly described are incorporated herein to illustrate a preferred embodiment of the invention and a best mode presently contemplated for carrying out the invention.

DESCRIPTION OF THE PREFERRED EMBODIMENT(S)

Figure 1:
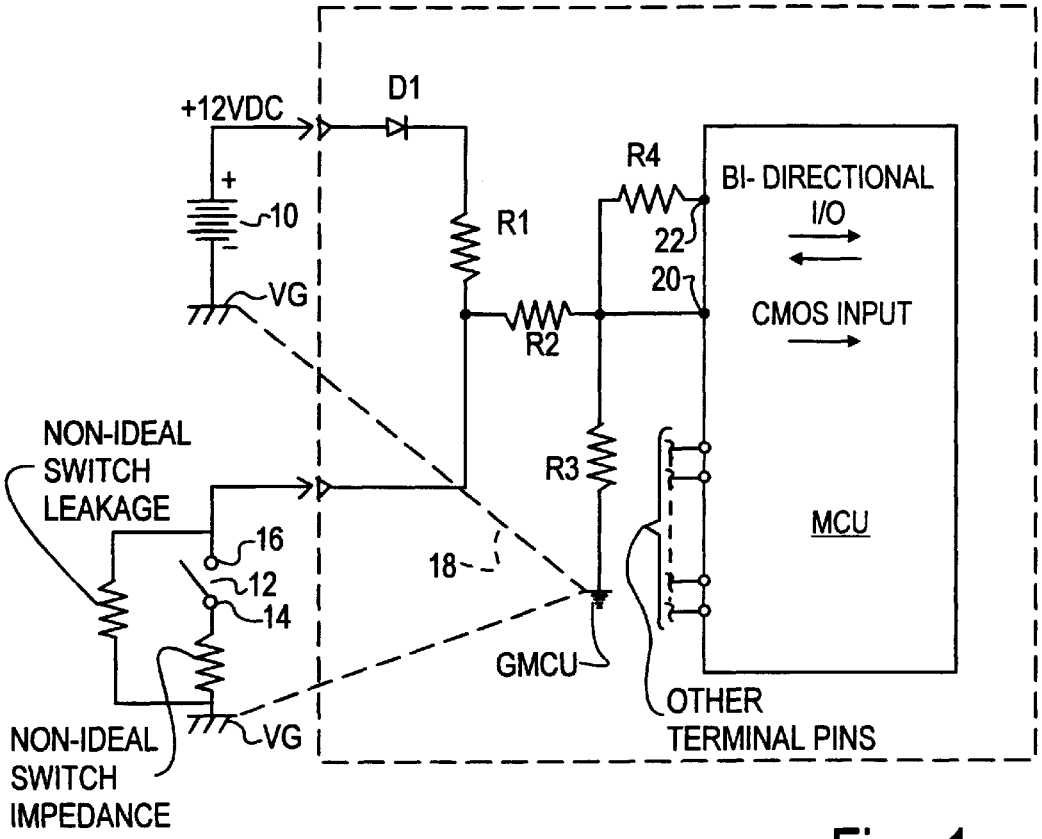
FIG. 1 is a schematic diagram of an electric circuit illustrative of principles of the present invention.

FIG. 1 shows a portion of an automotive vehicle electrical system including a circuit embodying principles of the present invention. The electrical system has a D.C. power supply 10 that is negatively grounded to provide a nominal positive D.C. supply voltage of +12 VDC. In actual operation of the vehicle, the nominal supply voltage may vary over a range extending from significantly less than nominal to significantly more than nominal.

A normally open mechanical switch 12 is representative of any of a number of various grounding switches that may be used in the vehicle. Switch 12 has a first, or input, terminal 14 that is connected to vehicle ground VG, and a second, or output, terminal 16. When switch 12 is open, terminal 16 is ungrounded, and when switch 16 is closed, terminal 16 is grounded through the closed switch contacts. Depending on conditions like those described earlier, the actual voltage at terminal 16 may include an offset from true ground, meaning offset from true zero volts. FIG. 1 depicts two resistance characteristics that cause the actual switch characteristics to depart from those of an ideal switch.

A passive processing circuit 18 processes the closure of switch 12 to a terminal pin 20 of a CMOS input of a microcontroller MCU. When switch 12 is open, the CMOS input should see a relatively more positive voltage corresponding with a logic "1" signal, and when switch 12 is closed, the CMOS input should see a relatively less positive voltage corresponding with a logic "0" signal. If the MCU is one that utilizes +5 VDC as its operating voltage, a zero volt signal at the CMOS input will be read as a logic "0" signal while a +5 VDC signal at the CMOS input will be read as a logic "1" signal. In actual operation, a signal that is somewhat greater than zero volts DC will be read definitively as a logic "0" signal while a signal that is somewhat smaller than +5 VDC will be read definitively as a logic "1" signal. For example, a signal between about +3.5 VDC and +5 VDC will be read as a logic "1" signal, and a signal between about +0 VDC and +1 VDC will be read as a logic "0" signal. A signal whose voltage is intermediate +1 VDC and +3.5 VDC represents an indeterminate signal that may be read either as a logic "1" signal or as a logic "0" signal depending on specific conditions prevailing at the time.

Processing circuit 18 comprises a diode D1 and three resistors R1, R2, and R3 connected in the same manner as in the known processing circuit that was described earlier. Processing circuit 18 further includes a fourth resistor R4 connected as illustrated between a terminal pin 22 of a bi-directional input/output (I/O) of the MCU and the common junction of resistors R2 and R3 and the CMOS input terminal pin 20. A Motorola HC12 MCU is an example of an MCU that has such bi-directional I/O's. The MCU has the ability to configure such a bi-directional I/O as either an input or an output. Such configuring is performed by internal software. When configured as an input, a bi-directional I/O provides a high impedance at its terminal pin, such as terminal pin 22. When configured as an output, a bi-directional I/O may be selectively driven to either one of two logic states, namely either a high logic state (a binary 1) or a low logic state (a binary 0).

Figure 2:
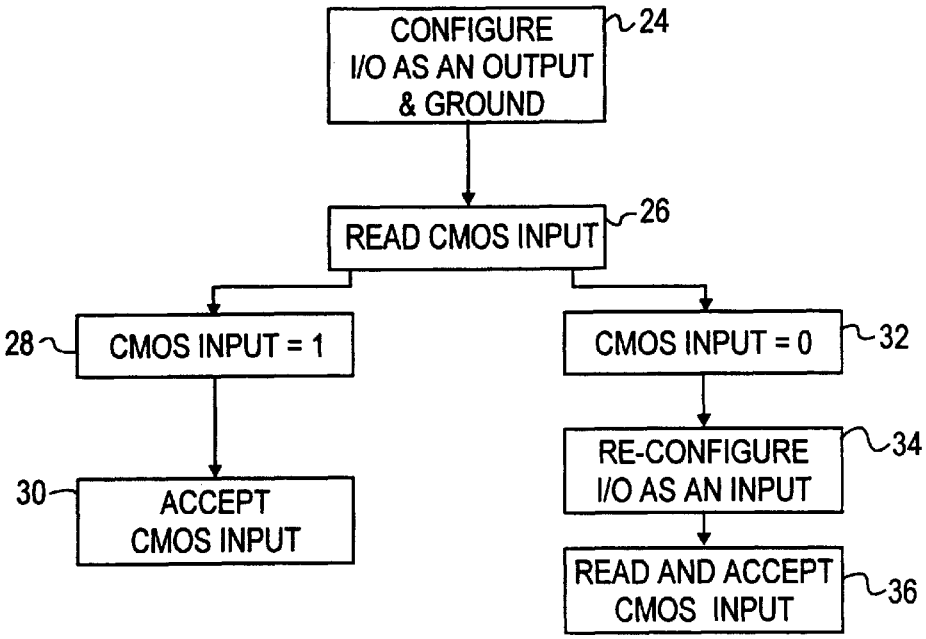
FIG. 2 is a flow diagram relating to operation of the circuit of FIG. 1.

FIG. 2 illustrates a sequence of steps that are executed when the MCU is ready to read the CMOS input in order to ascertain the condition of switch 12.

Step 24 comprises configuring the bi-directional I/O as an output that is driven to ground potential of the MCU, as represented by the symbol GMCU in FIG. 1. Although the MCU ground and the vehicle ground VG are in common, their actual potentials may differ due to ground offset. With one terminal of resistor R4 thus grounded, the MCU is prepared to read the switch condition by performing a step 26 of reading the CMOS input, such input being in common with the other terminal of resistor R4. If the MCU reads a logic "1" signal, meaning that switch 12 is open, the signal is accepted as correct by the MCU (steps 28, 30).

However, if the signal is instead read as a logic "0" signal (step 32), then the MCU, by software operation, re-configures the bi-directional I/O as an input (step 34). The net effect is to create a very high impedance in series with resistor R4 preventing essentially any current flow through resistor R4. In this way resistor R4 is effectively out of the circuit. The MCU now reads the CMOS input again, and it accepts whatever that reading is as the correct switch condition (step 36).

By themselves, resistors R2 and R3 form a voltage divider that relates the voltage at the CMOS input to the ratio of the resistance of resistor R3 to the sum of the resistances of resistors R2 and R3. (The resistance of resistor R1 is ignored because it is low, 750 ohms for example, in comparison to the sum of the resistances of resistors R2 and R3, 30 kohms to 50 kohms for example.) The inclusion of resistor R4, as shown, and the operation, as described, are effective to change the voltage divider ratio whenever the bi-directional I/O is driven to ground because resistor R4 is thereby placed in parallel with resistor R3.

The following description demonstrates how the invention makes the reading of switch 12 by microcontroller MCU robust both to fluctuations in power supply 10 from its nominal 12 volts D.C. and to offsets in the vehicle ground from zero volts D.C.

Assume that switch 12 is open during the time that it is being read by the CMOS input of microcontroller MCU so that a logic one would be the correct reading. Before the switch is read, resistor R4 is placed in circuit by microcontroller MCU configuring its bi-directional I/O as an output that is driven to ground. Consequently, the voltage divider ratio formed by the parallel combination of resistors R3 and R4 (R31||R4) divided by the sum of the resistance of resistor R2 and the resistance of this parallel combination (R31||R4) is substantially 0.45. With that voltage divider ratio present, the microcontroller then reads the CMOS input. If that input is read as a logic one, then switch 12 is read as being open, and that reading is accepted as correct on the basis of the following reasoning.

In order for the CMOS input to have been read in the presence of the 0.45 voltage divider ratio as a logic zero (closed switch) instead of a logic one (open switch), certain extreme degradations would have had to be present in the power supply and/or switch characteristics, such as a supply voltage 17.5 v., a ground offset 1 v., and/or a switch impedance of 50 ohms. Because the likelihood of such extreme degradations is remote, the reading of a logic one is accepted as correct.

However, if the CMOS input had instead been read as a logic zero while the 0.45 voltage divider ratio was present and switch 12 was in fact open, such a false reading could be attributable to certain other extreme degradations, such as an 8.5 v. voltage of power supply 10, ground offset of −1 v., and switch impedance of 50 k ohms. To guard against acceptance of an incorrect reading, the following steps ensue whenever a logic zero results from the first reading.

Microcontroller MCU re-configures bi-directional I/O from being a grounded output to a high impedance input thereby effectively removing resistor R4 from the circuit. With resistor R4 removed, the voltage divider ratio of the resistance of resistor R3 to the sum of the resistances of resistors R3 and R2 becomes 0.63. With this ratio present the CMOS input is read. If the CMOS input is read as a logic one, indicating that switch 12 is open, that reading is accepted as correct because the 0.63 ratio allows for the low BAT (BAT=6v), VG=−1v, and switch leakage=50 k ohms to be properly read as a one with the switch open (meaning that 0.45 ratio used earlier interpreted as a zero was incorrect). On the other hand, if the CMOS input is read as a logic zero, the switch is read as being closed, and that reading is accepted as correct because both the 0.45 and the 0.63 ratios can properly read a closed switch under the extreme conditions of BAT=16v, VG=1v, switch impedance=50 ohms.

Thus, the inventive principles have been shown to provide an improved passive processing, or conditioning, circuit for processing, or conditioning, a ground signal from a mechanical switch. The improved circuit remains passive, including just one more resistor than the previously known circuit. The invention extends the range of supply line voltage over which a CMOS input can correctly read a mechanical switch in a cost-effective manner. Although switch 12 has been described as a normally closed switch, it should be appreciated that the most comprehensive inventive principles extend to other forms of switches, including normally closed mechanical switches.

While a presently preferred embodiment has been illustrated and described, it is to be appreciated that the invention may be practiced in various forms within the scope of the following claims.

What is claimed is:

1. A processing circuit for use with a D.C. power supply that comprises supply and ground potentials to process ground side closure of a switch to a CMOS input of an MCU that also has a bi-directional input/output, the processing circuit comprising, in combination with the switch and MCU:

a first resistor through which an output of the switch to which ground is switched during switch closure is adapted to be connected to the supply potential;

second and third resistors in series, in that order, through which the switch output is adapted to be connected to ground potential; and a fourth resistor through which the bi-directional I/O of the MCU is connected to a node that is common to the CMOS input, to the second resistor, and to the third resistor for causing the equivalent resistance between that node and ground potential to be relatively larger when the MCU is configuring the bi-directional I/O as an input and to be relatively smaller when the MCU is configuring the bi-directional I/O as an output to ground.

2. A processing circuit as set forth in claim 1 further including a diode in series with the first resistor.

3. A processing circuit as set forth in claim 1 in which the switch comprises mechanical switch contacts that make when the switch is operated closed and that break when the switch is operated open.

4. A processing circuit as set forth in claim 1 in which the MCU is programmed with an algorithm that configures the bi-directional input/output of the MCU to allow the fourth resistor to coact with the second and third resistors, and that, when the MCU reads a signal at the CMOS input as one logic level of a binary logic signal, accepts that one logic level as a correct signal, but that, when the MCU is reads a signal at the CMOS input as the other level of the binary logic signal, re-configures the bi-directional input/output to disallow the fourth resistor from coacting with the second and third resistors, and then re-reads the signal and accepts the re-read signal at the CMOS input as a correct signal.

5. A processing circuit as set forth in claim 4 in which the MCU causes the bi-directional input/output to be configured as a ground when the MCU reads a signal at the CMOS input as the one logic level of the binary logic signal, and accepts that one logic level as a correct signal, but when the MCU reads a signal at the CMOS input as the other level of the binary logic signal, the MCU causes the bi-directional input/output to be re-configured as a very high impedance input that prevents the fourth resistor from coacting with the second and third resistors, and then re-reads the signal at the CMOS input, and accepts the re-read signal as a correct signal.

6. An automotive vehicle comprising:

an electrical system including an electric power supply that delivers D.C. electric power across supply and ground potentials;

a ground connection from the ground potential of the D.C. electrical system to vehicle ground;

a switch comprising switch contacts between a first terminal of the switch and a second terminal of the switch and selectively operable to open and closed states to open and close a current path between the first and second terminals;

a ground connection from the first switch terminal to vehicle ground;

an MCU that is supplied with electric power derived from the vehicle electrical system, and that has an MCU ground, a bi-directional input/output, and a CMOS input;

a ground connection from the MCU ground to vehicle ground;

a processing circuit connecting the switch to the vehicle electrical system and to the MCU for enabling the MCU to read the state of the switch contacts;

the processing circuit comprising a first resistor through which an output of the switch to which ground is switched during switch closure is adapted to be connected to the supply potential; second and third resistors in series, in that order, through which the switch output is adapted to be connected to ground potential; and a fourth resistor through which the bi-directional I/O of the MCU is connected to a node that is common to the CMOS input, to the second resistor, and to the third resistor for causing the equivalent resistance between that node and ground potential to be relatively larger when the MCU is configuring the bi-directional I/O as an input and to be relatively smaller when the MCU is configuring the bi-directional I/O as an output to ground.

7. An automotive vehicle as set forth in claim 6 further including a diode in series with the first resistor.

8. An automotive vehicle as set forth in claim 6 in which the switch comprises mechanical switch contacts that make when the switch is operated closed and that break when the switch is operated open.

9. An automotive vehicle as set forth in claim 8 in which the MCU is programmed with an algorithm that configures the bi-directional input/output of the MCU to allow the fourth resistor to coact with the second and third resistors, and that, when the MCU reads a signal at the CMOS input as one logic level of a binary logic signal, accepts that one logic level as a correct signal, but that, when the MCU is reads a signal at the CMOS input as the other level of the binary logic signal, re-configures the bi-directional input/output to disallow the fourth resistor from coacting with the second and third resistors, and then re-reads the signal and accepts the re-read signal at the CMOS input as a correct signal.

10. An automotive vehicle as set forth in claim 9 in which the MCU causes the bi-directional input/output to be configured as a low-impedance ground when the MCU reads a signal at the CMOS input as the one logic level of the binary logic signal, and accepts that one logic level as a correct signal, but when the MCU reads a signal at the CMOS input as the other level of the binary logic signal, the MCU causes the bi-directional input/output to be re-configured as a very high impedance input that prevents the fourth resistor from coacting with the second and third resistors, and then re-reads the signal at the CMOS input, and accepts the re-read signal as a correct signal.

11. A method for an MCU that has a CMOS input and a bi-directional input/output to read closure of a grounding type switch in an automotive vehicle that has a D.C. voltage source, wherein a processing circuit that includes a first resistor through which an output of the switch to which ground is switched during switch closure is connected to a supply potential of the D.C. voltage source, second and third resistors in series, in that order, through which the switch output is connected to a ground, and a fourth resistor through which the bi-directional I/O of the MCU is connected to a node that is common to the CMOS input, to the second resistor, and to the third resistor, the method comprising:

configuring the bi-directional input/output to allow the fourth resistor to coact with the second and third resistors, and while the bi-directional input/output is so configured, reading a signal at the CMOS input;

accepting the read signal as a correct signal if the read signal corresponds with one logic level of a binary logic signal;

if the read signal corresponds with the other logic level of the binary signal, re-configuring the bi-directional input/output to disallow the fourth resistor from coacting with the second and third resistors, and then re-reading the signal at the CMOS input; and accepting the re-read signal at the CMOS input as a correct signal.

12. A method as set forth in claim 11 in which the step of accepting the read signal as a correct signal if the read signal corresponds with one logic level of a binary logic signal comprises accepting the read signal as a correct signal if the read signal corresponds with a relatively more positive polarity voltage that corresponds with the one logic level; and the step of re-configuring the bi-directional input/output to disallow the fourth resistor from coacting with the second and third resistors if the read signal corresponds with the other logic level of the binary signal comprises re-configuring the bi-directional input/output to disallow the fourth resistor from coacting with the second and third resistors if the read signal corresponds with a relatively less positive polarity voltage that corresponds with the other logic level.

* * * * *